US005235717A

United States Patent [19]

Lanzo, Jr. et al.

[11] Patent Number: 5,235,717

[45] Date of Patent: Aug. 17, 1993

[54] ROTARY SCRUBBER APPARATUS

[76] Inventors: Albert J. Lanzo, Jr.; Laura M. Lanzo, both of 76 Pendleton La., Londonderry, N.H. 03053; Albert J. Lanzo, Sr., 14 Reynolds Rd., Wakefield, Mass. 01880

[21] Appl. No.: 981,056

[22] Filed: Nov. 24, 1992

[51] Int. Cl.[5] ..... A46B 13/06

[52] U.S. Cl. ..... 15/97.1; 15/22.1; 15/24

[58] Field of Search ..... 15/22.1, 24, 29, 97.1, 15/104.9; 128/37, 56, 66

[56] References Cited

U.S. PATENT DOCUMENTS 3,632,191 3/1953 Grafani et al. ..... 15/22.1

*Primary Examiner*—Edward L. Roberts

*Attorney, Agent, or Firm*—Leon Gilden

[57] ABSTRACT

A rotary spherical scrubber formed of a fluid permeable material is arranged for rotative mounting relative to a support conduit, wherein the support conduit directs fluid interiorly of the scrubber directing fluid spray from nozzles interiorly of the scrubber onto vanes within the scrubber for rotation of the scrubber.

7 Claims, 4 Drawing Sheets

ROTARY SCRUBBER APPARATUS

BACKGROUND OF THE INVENTION

1. Field of the Invention

The field of invention relates to cleaning apparatus, and more particularly pertains to a new and improved rotary scrubber apparatus arranged for the rotative cleaning of surfaces.

2. Description of the Prior Art

The cleaning of tubs, showers, and the like is typically associated with a manually intensive procedure. Prior art scrubber structure such as indicated in U.S. Pat. No. 3,731,334 to Carbonell sets forth a scrubber utilizing a motor powered rotary brush structure.

U.S. Pat. No. 4,686,729 to Roman sets forth a scrubber having rotary blades mounted within a housing in fluid communication with a conduit as the individual matrix rotary brushes is mounted medially of a bottom wall of the housing.

Accordingly, it may be appreciated there continues to be a need for a new and improved rotary scrubber apparatus as set forth by the instant invention addressing both the problems of ease of use as well as effectiveness in construction in effecting the rotary cleaning of a surface and in this respect, the present invention substantially fulfills this need.

SUMMARY OF THE INVENTION

In view of the foregoing disadvantages inherent in the known types of scrubber apparatus now present in the prior art, the present invention provides a rotary scrubber apparatus wherein the same utilizes jet nozzles to effect rotary displacement of vanes within a rotary spherical member. As such, the general purpose of the present invention, which will be described subsequently in greater detail, is to provide a new and improved rotary scrubber apparatus which has all the advantages of the prior art scrubber apparatus and none of the disadvantages.

To attain this, the present invention provides a rotary spherical scrubber formed of a fluid permeable material arranged for rotataive mounting relative to a support conduit, wherein the support conduit directs fluid interiorly of the scrubber directing fluid spray from nozzles interiorly of the scrubber onto vanes within the scrubber for rotation of the scrubber.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rotary scrubber apparatus which has all the advantages of the prior art scrubber apparatus and none of the disadvantages.

It is another object of the present invention to provide a new and improved rotary scrubber apparatus which may be easily and efficiently manufactured and marketed.

It is a further object of the present invention to provide a new and improved rotary scrubber apparatus which is of a durable and reliable construction.

An even further object of the present invention is to provide a new and improved rotary scrubber apparatus which is susceptible of a low cost of manufacture with regard to both materials and labor, and which accordingly is then susceptible of low prices of sale to the consuming public, thereby making such rotary scrubber apparatus economically available to the buying public.

Still yet another object of the present invention is to provide a new and improved rotary scrubber apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
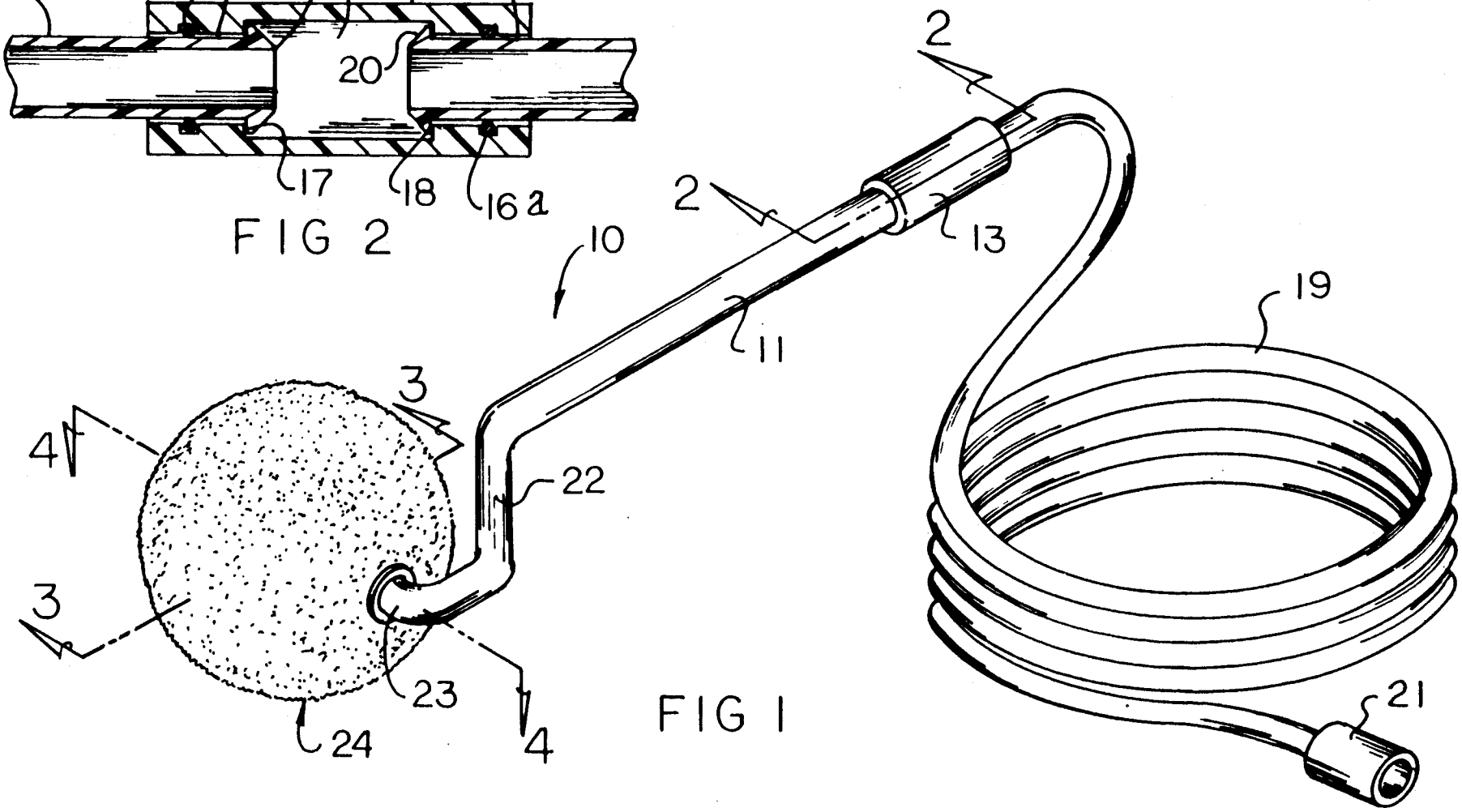
FIG. 1 is an isometric illustration of the instant invention.

With reference now to the drawings, and in particular to FIGS. 1 to 10 thereof, a new and improved rotary scrubber apparatus embodying the principles and concepts of the present invention and generally designated by the reference numeral 10 will be described.

More specifically, the rotary scrubber apparatus 10 of the instant invention essentially comprises a rigid conduit having a conduit first leg 11, with a conical first end 12 for reception within a coupling tube first bore 14 of a coupling tube 13. The coupling tube first bore is of a first diameter that is coaxially aligned with a coupling tube third bore 16 of said first diameter, with an intermediate second bore 15 of a second diameter greater than the first and third bores. A sealing ring 14*a* is positioned within the first bore 14 and a second sealing ring 16*a* positioned within the third bore 16. The conical first end 12 is received upon a first shoulder 17 at an inner face of the first bore 14 with the second bore 15. A second shoulder 18 receives a fluid hose conical first end 20 of a flexible fluid hose 19 whose fluid hose second end terminates in a second end connector 21 for coupling to various fluid water sources under pressure, such as in a faucet and the like. In this manner, the second end connector 21 is typically of a flexible resilient construction.

The rigid conduit first leg 11 includes a conduit second leg 22 of an angulated orientation terminating in a conduit third leg 23 that is orthogonally oriented relative to the first leg 11. In this manner, a cleaning sphere 24 is rotatably mounted about the third leg 23, with the first leg 11 radially aligned with the cleaning sphere 24. The cleaning sphere 24 includes a cleaning sphere cylindrical cavity 27 having a cavity first end wall 28 spaced from a cavity second end wall 29, having respective first and second outlet conduits 31 and 32 projecting from the respective first and second end walls 28 and 29. The outlet ports are directed into a porous sponge body 35 having an outer fluid permeable spherical layer 36, including a mesh web 37 in surrounding relationship relative to the spherical layer 36 to enhance cleaning and further, a matrix of filaments 38 may be fixedly mounted coextensively about the mesh web 37 to further enhance cleaning utilizing the sphere 24. First and second nozzles 25 and 26 are fixedly and orthogonally oriented relative to the conduit third leg 23, with the first and second nozzles 25 and 26 angulated for impingement upon a plurality of vanes 30 arranged in an annular array within the cylindrical side wall of the cylindrical cavity 27. In this manner, as the nozzles 25 and 26 direct pressurized fluid onto the vanes, rotation of the sphere 24 is effected as the sphere is rotatably mounted about the third conduit 23, with the vanes fixedly mounted to the cylindrical side wall of the cavity 27.

Further, the cylindrical side wall includes side wall primary conduits 33, with each of the conduits 33 having a plurality of secondary conduits 34 directing fluid through the sponge body 35, the fluid permeable spherical layer 36, the mesh web 37, and projecting through the filaments 38 to direct pressure onto a surface to be cleaned.

Figure 2:
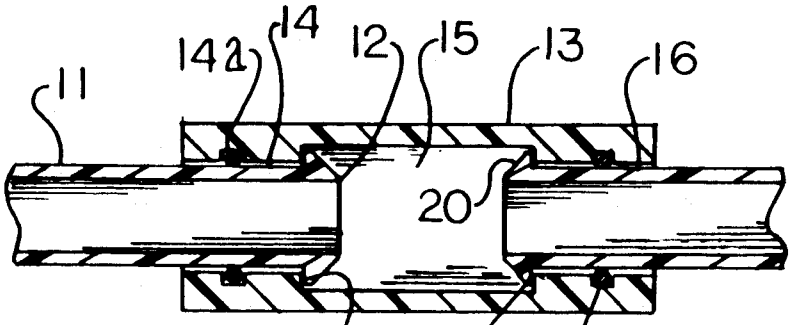
FIG. 2 is an orthographic view, taken along the lines 2—2 of FIG. 1 in the direction indicated by the arrows.
Figure 3:
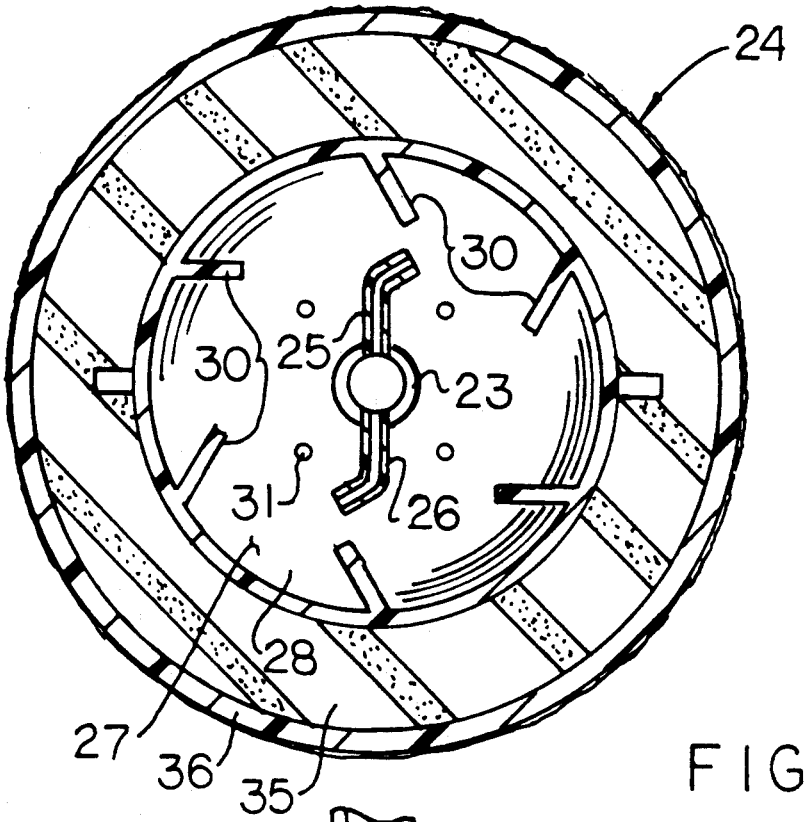
FIG. 3 is an orthographic view, taken along the lines 3—3 of FIG. 1 in the direction indicated by the arrows.
Figure 4:
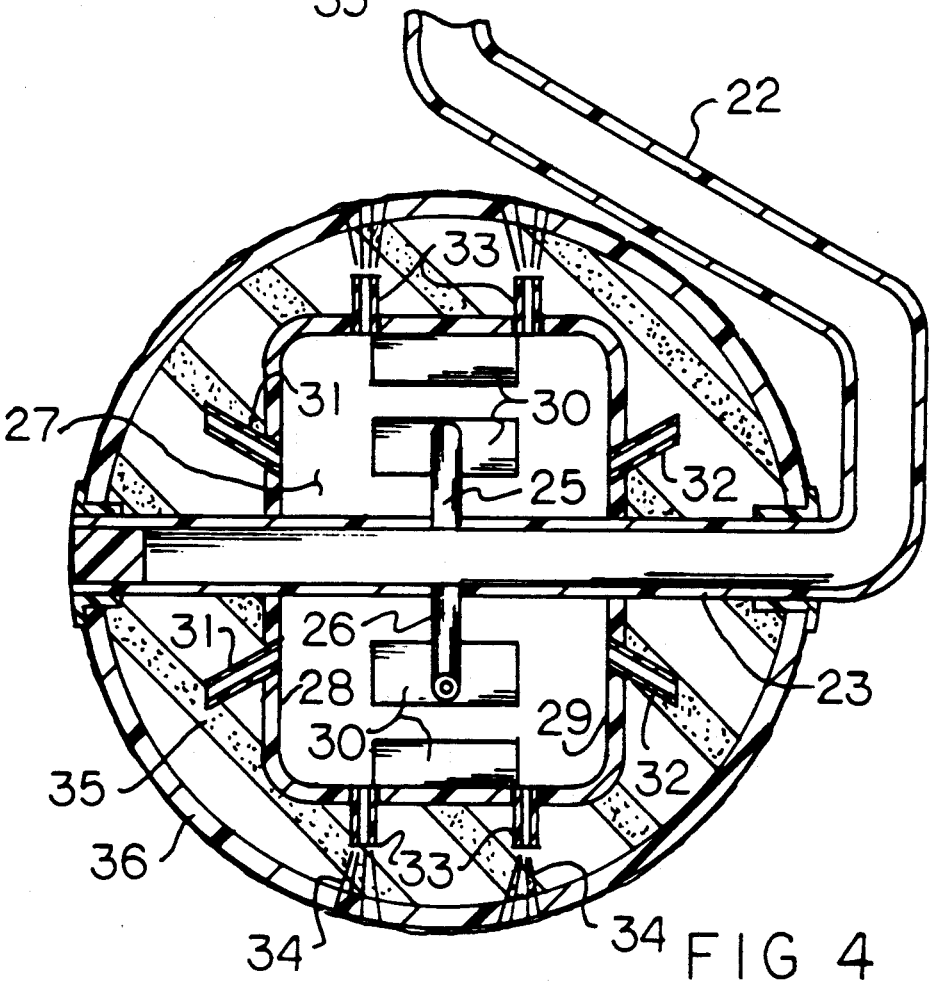
FIG. 4 is an orthographic view, taken along the lines 4—4 of FIG. 1 in the direction indicated by the arrows.
Figure 5:
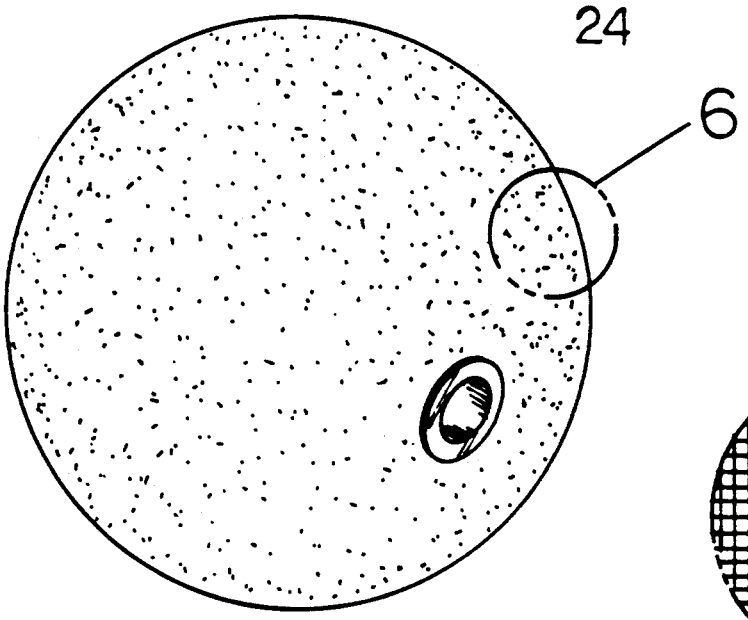
FIG. 5 is an exterior surface of the rotary scrubber sphere.
Figure 6:
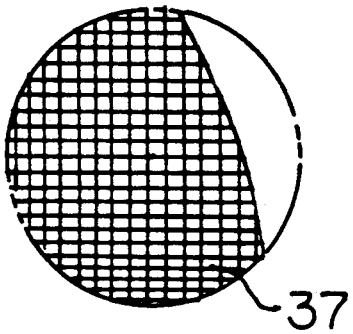
FIG. 6 is an enlarged orthographic view of section 6 as set forth in FIG. 5.
Figure 7:
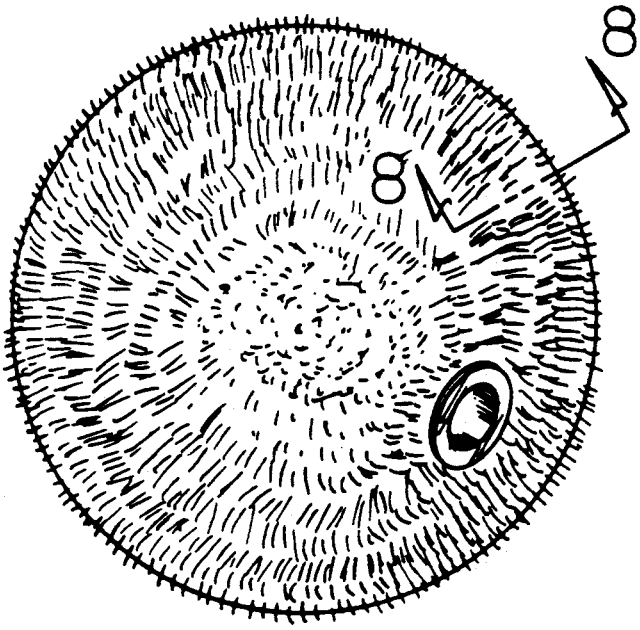
FIG. 7 is a further indication of a rotary sphere structure.
Figure 8:
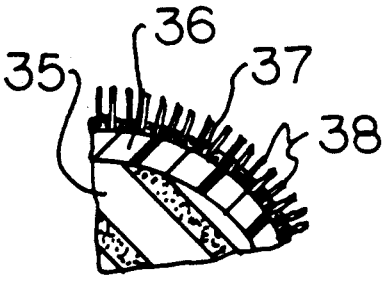
FIG. 8 is an orthographic view, taken along the lines 8—8 of FIG. 7 in the direction indicated by the arrows.
Figure 9:
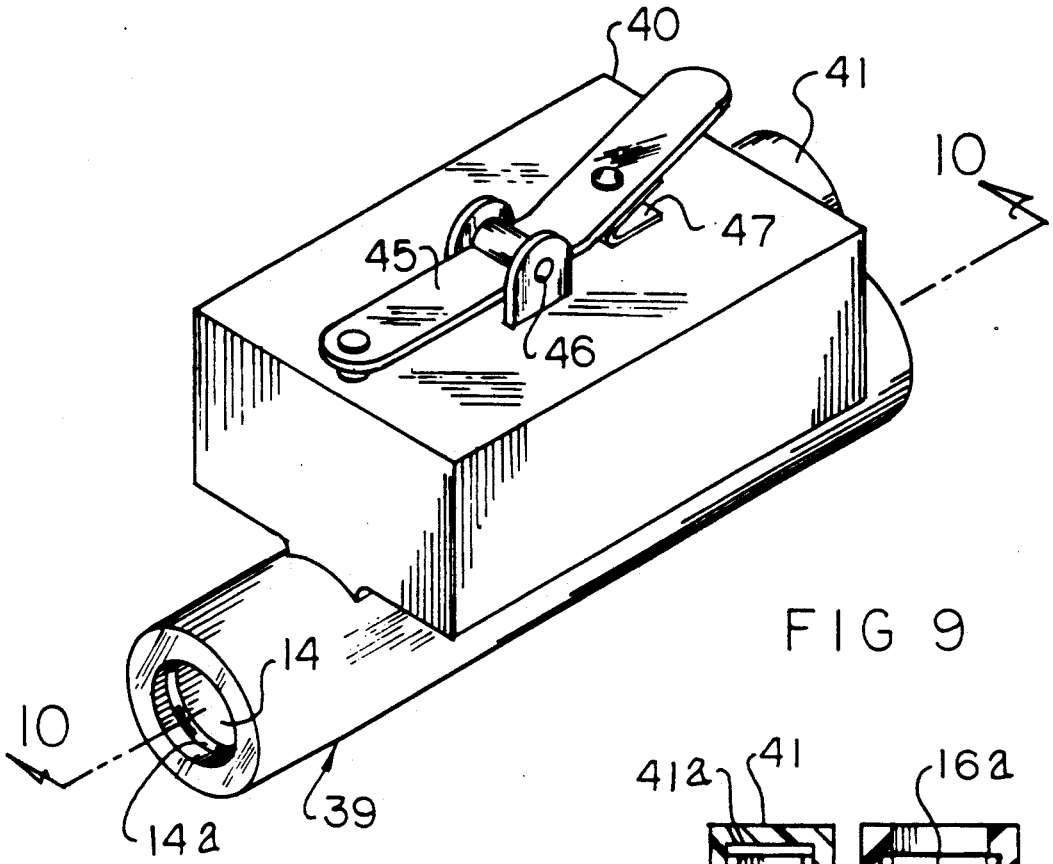
FIG. 9 is an isometric illustration of a modified coupling structure of the invention.
Figure 10:
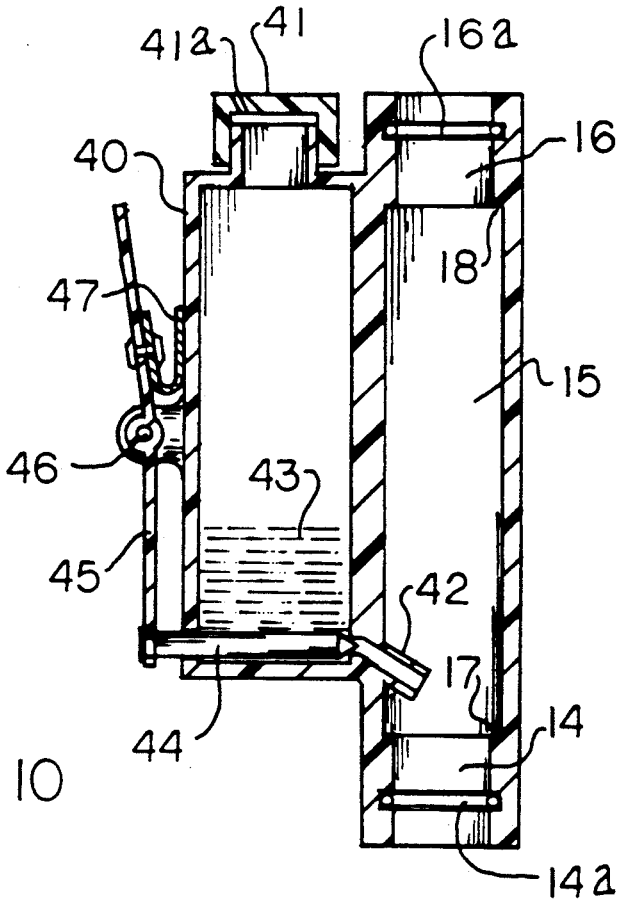
FIG. 10 is an orthographic view, taken along the lines 10—10 of FIG. 9 in the direction indicated by the arrows.

The FIGS. 9 and 10 indicate the use of a modified coupling tube 39 in addition to the structure as indicated in FIG. 2, and includes a fluid reservoir housing 40 mounted to the coupling, with a housing lid 41 permitting replenishment of a cleaning fluid 43 within the reservoir. A fluid outlet port 42 is directed from the reservoir housing into the coupling conduit and more specifically, the second bore 15, with the outlet port 42 angulated towards the first bore 14. In this manner, a venturi effect is created directing fluid from the reservoir 40 into fluid directed along the first, second, and third bores 14, 15, and 16. The housing lid 41 for this purpose is vented such as by vent port 41*a* to prevent vacuum formation within the reservoir housing 40. A plunger rod 44 is arranged for projection into the fluid outlet port 42 within the reservoir housing, with a first end of the plunger rod 44 directed into the fluid port, with the second end mounted to a lever 45 positioned exteriorly of the housing 40 pivotal about a pivot axle 46, with a lever spring 47 interposed between the lever and the housing to normally bias the plunger rod 44 into sealing relationship with the outlet port 42.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotary scrubber apparatus, comprising, a rigid conduit having a first leg, and a second leg angularly oriented relative to the first leg, and a third leg orthogonally oriented relative to the first leg, and a rotary cleaning sphere rotatably mounted about the third leg, with the first leg radially aligned with the cleaning sphere, and the first leg, the second leg, and the third leg arranged in fluid communication relative to one another, and rotating means mounted within the cleaning sphere for effecting rotation of the cleaning sphere upon pressurized fluid directed into the third leg.

2. An apparatus as set forth in claim 1 with the rotating means including a cylindrical cavity mounted within the cleaning sphere, the cylindrical cavity having a first end wall having a plurality of first outlet conduits directed from the cavity, and a second end wall having a plurality of second conduits directed therethrough in fluid communication with the cavity, and the cavity having a cylindrical side wall, with the cylindrical side wall including a plurality of spaced vanes fixedly mounted to the side wall, and the third leg having a first nozzle and a second nozzle, with the first nozzle and the second nozzle orthogonally oriented relative to the third leg and in fluid communication with the third leg, wherein the first nozzle and the second nozzle are arranged for directing pressurized fluid flow onto the vanes for rotation of the cleaning sphere.

3. An apparatus as set forth in claim 2 wherein the cavity side wall includes a plurality of primary conduits, and each of the primary conduits includes a plurality of secondary conduits directed from each primary conduit coextensively through the cleaning sphere, the cleaning sphere having a porous sponge body in surrounding relationship relative to the cavity, and an outer fluid permeable spherical layer coextensively directed about the sponge body, and a mesh web arranged coextensively about the spherical layer.

4. An apparatus as set forth in claim 3 wherein the mesh web includes a matrix of filaments fixedly mounted to the mesh web coextensive of the mesh web.

5. An apparatus as set forth in claim 4 wherein the first leg includes a conical end and a coupling tube, the coupling tube having a first bore of a first diameter in fluid communication with the second bore having a second diameter greater than the first diameter, and a third bore in communication with the second bore spaced from the first bore, wherein the third bore has a third bore diameter less than the second diameter, and a first shoulder oriented at an inner face of the first bore and the second bore, and the second shoulder oriented at an inner face of the second bore and the third bore, wherein the conical end projects exteriorly of the first leg and is mounted on the first shoulder, and a flexible fluid hose having a fluid hose conical end, and the fluid hose conical end is positioned on the second shoulder.

6. An apparatus as set forth in claim 5 wherein the coupling tube further includes a fluid reservoir housing fixedly mounted to the coupling tube, and a housing lid directed into the reservoir housing for replenishment of fluid within the reservoir housing, and an outlet port directed from the reservoir housing into the second bore and canted towards the first bore.

7. An apparatus as set forth in claim 6 including a plunger rod reciprocatably mounted within the reservoir housing, with the plunger rod having a first end arranged for reception within the outlet port within the reservoir housing, and the plunger rod having a second end projecting exteriorly of the housing, and a lever pivotally mounted exteriorly of the reservoir housing, the lever pivotally mounted about a pivot axle, and the plunger rod second end mounted to the lever, and a lever spring interposed between the lever and the reservoir housing to bias the plunger rod first end into the outlet port.

* * * * *